US006595250B1

(12) United States Patent
Paulus

(10) Patent No.: US 6,595,250 B1
(45) Date of Patent: Jul. 22, 2003

(54) MOBILE FLUID PRODUCT FILLING SYSTEM WITH FAST SETUP

(75) Inventor: Larry Charles Paulus, Madison, WI (US)

(73) Assignee: Ideal Manufacturing Sales Corp., Madison, WI (US)

( * ) Notice: Subject to any disclaimer, the term of this patent is extended or adjusted under 35 U.S.C. 154(b) by 1 day.

(21) Appl. No.: 10/086,098

(22) Filed: Feb. 28, 2002

(51) Int. Cl.[7] ..... B65B 3/00

(52) U.S. Cl. ..... 141/231; 141/128; 141/129; 141/83; 141/153; 141/156

(58) Field of Search ..... 141/83, 128, 129, 141/153, 156, 157, 159, 160, 177, 183, 188, 189, 231; 222/608

(56) References Cited

U.S. PATENT DOCUMENTS

| | | | | | |
|---|---|---|---|---|---|
| 1,959,694 | A | | 5/1934 | Stevens | |
| 2,673,019 | A | * | 3/1954 | Smith | 141/99 |
| 2,781,799 | A | * | 2/1957 | Bradford | 141/68 |
| 3,419,052 | A | * | 12/1968 | Morine | 141/102 |
| 3,785,412 | A | * | 1/1974 | Stone | 141/83 |
| 4,398,577 | A | | 8/1983 | Sauer | |
| 4,411,295 | A | | 10/1983 | Nutter | |
| 4,445,548 | A | | 5/1984 | Neumann | |
| 4,843,579 | A | | 6/1989 | Andrews et al. | |
| 4,957,147 | A | | 9/1990 | Lowe | |
| 5,105,859 | A | * | 4/1992 | Bennett et al. | 141/102 |
| 5,381,837 | A | * | 1/1995 | Kurosu et al. | 141/103 |
| 5,505,233 | A | | 4/1996 | Roberts et al. | |
| 6,145,552 | A | * | 11/2000 | Price et al. | 141/135 |
| 6,148,877 | A | | 11/2000 | Bethke | |
| 2002/0144748 | A1 | * | 10/2002 | Price et al. | 141/129 |

* cited by examiner

*Primary Examiner*—J. Casimer Jacyna
(74) *Attorney, Agent, or Firm*—Craig A. Fieschko, Esq.; DeWitt Ross & Stevens S.C.

(57) ABSTRACT

A fluid filling system has a filling unit which is repositionable with respect to a filling station. The filling unit includes a filling head and a dispensing switch. The filling station has a filling position at which a container may be placed for filling with fluid. A container fill sensor is provided at the filling position so that it may detect the degree to which a container is filled. A movable switching member is also provided on the filling station, and it communicates with the container fill sensor and moves to different positions in accordance with the degree to which a container at the filling position is filled. The filling unit is repositionable with respect to the filling station so that the filling unit may be situated adjacent the filling station with its filling head situated over the filling position, or may be moved to allow the filling unit to rest at other locations. When the filling unit is resting adjacent the filling station with its filling head situated over the filling position (i.e., when it is in the ready-to-fill position), the switching member and dispensing switch are adjacently situated between the filling unit and filling station so that the switching member may actuate the dispensing switch. Thus, when the container fill sensor detects that container filling is to occur (or is to cease), the switching member is actuated, which in turn actuates the dispensing switch to change the filling head between its filling state and its nonflow state in accordance with the filling detected by the container fill sensor.

22 Claims, 1 Drawing Sheet

MOBILE FLUID PRODUCT FILLING SYSTEM WITH FAST SETUP

FIELD OF THE INVENTION

This disclosure concerns an invention relating generally to methods and apparata for fluid dispensation, i.e., the dispensation of liquids and flowing powders, particulates, or other solids. The invention relates more particularly to methods and apparata which are particularly suitable for use in automatic and semi-automatic container fillers for filling containers with a desired amount of fluid product.

BACKGROUND OF THE INVENTION

The three most common types of fluid filling schemes are volumetric filling, time-metered filling, and weight-metered filling (also referred to as gravimetric filling). All are commonly implemented in semi-automatic or automatic filling systems wherein empty containers are carried by conveyors or other transport mechanisms to filling positions. Once the containers reach the filling positions, they are stopped, filled to the desired degree by filling heads (e.g., nozzles or other dispensing apparata), and then released upon completion of the fill. In other instances, no container transport mechanisms are utilized and the containers are simply placed by hand at the filling station, filled, and then removed by hand after filling.

In volumetric filling (also known as volume-metered filling), a set volume of fluid is dispensed into a container: a chamber is set to a desired volume, the chamber is filled with fluid, and the contents of the chamber are then dispensed into a container. The chamber is generally provided by a cylinder which is emptied by a piston. Volumetric filling is subject to the disadvantages that filling accuracy is limited by the accuracy of the control of the chamber volume, and filling speed is limited by the time necessary for refilling the chamber. Volumetric filling is also unsuitable where one wishes to fill a container with a desired weight of fluid: variations in fluid density will lead to variations in the weight of the fluid dispensed from the chamber and result in different weights being dispensed into different containers; viscous fluids may stick to the dispensing apparatus and result in incomplete dispensation; and so forth.

In time-metered filling (also known as time-metered volumetric filling), fluid is dispensed from a nozzle having a known volumetric flow rate for a set amount of time sufficient to fill the containers with a set volume of fluid. Time-metered filling is advantageous in terms of productivity insofar as one may reduce filling time per container to any desired level so long as the appropriate volumetric flow rate is obtainable. However, time-metered filling is subject to inaccuracy unless a constant flow rate is precisely maintained, and this is particularly difficult to attain where flow rates are high. Additionally, time-metered filling is subject to the same disadvantages as volumetric filling in that variations in fluid density will result in different weights of fluid being dispensed to different containers, even if the volume of the dispensed fluid remains relatively constant from container to container.

Weight-metered (gravimetric) filling utilizes a weight sensor which monitors the amount of fluid received by a container. The weight sensor provides feedback to the dispensing apparatus, which halts dispensation when a desired weight of fluid is received. Weight-metered filling can be more accurate than volume-metered and time-metered filling, but it unfortunately has several significant disadvantages. First, the weight sensors and feedback apparata are quite costly if any reasonable degree of accuracy is required. Second, the filling time per container tends to be significantly longer owing to the weight feedback; sensitive weight sensors need time to "settle" prior to giving accurate weight readings, and additionally slower filling rates must often be used since the flow must be cut off precisely at or slightly before the time the desired weight is reached, or overshoot will result in an overweight container with product "give-away".

Regardless of whatever filling methodology is used, it has long been recognized that the versatility of filling units (i.e., the devices that perform the filling function) are significantly enhanced if the filling units are repositionable between different filling stations (i.e., the conveyors or other areas at which filling is to be performed), or to cleaning and maintenance areas. Apart from enhancing the ease of repairs and cleaning of filling units, this allows a single filling unit to be used at a variety of different filling stations, and additionally different filling units may be interchangeably used at the same filling station. As an example, mobile semiautomatic volumetric filling units have been well known for many years. As an example, the NEUMO Model SAF filling unit (Cherry Burrell, Delavan, Wis.) provided a piston/cylinder volumetric pump on a wheeled base, with the cylinder being supplied with fluid from a product hose (which could be connected to a product supply tank or the like) and in turn supplying a filling head. A foot pedal was supplied so that depression of the foot pedal would actuate the volumetric pump. Thus, a user could situate a container at a filling station, wheel the filling unit over to the filling station so that the filling head rested over the container, and the pedal could then be depressed to fill the container.

U.S. Pat. No. 4,445,548 to Neumann describes a mobile filling unit wherein a filling head is provided on a wheeled base. The filling head is supplied with fluid via a conduit which may be connected and disconnected from a fluid product source. The wheeled base is provided with retractable legs so that the filling unit may be fixed in position once it is wheeled to a desired filling station, with the filling head positioned over filling positions to which empty containers are indexed for filling. Metered filling is accomplished by means of monitoring the level of fluid received in the filled containers. As fluid is dispensed from the filling head, a collar surrounding the filling head floats or rides on the surface of the dispensed fluid, and the collar will eventually trigger a limit switch on the filling unit when the fluid fills the container to a desired level. Once filling is completed, an empty container is situated under the filling head and the operator recommences the filling process. Filling of subsequent containers is made somewhat easier by supplying them to the filling station on a conveyor, and additionally the filling head extends or retracts after each filling cycle so that the filling unit can more easily dispense fluids into containers in both lanes of a dual-lane conveyor.

Such semiautomatic filling systems, while useful, are not well suited for high production speeds and significant output of filled containers. In these situations, automatic filling systems are preferable, with containers being supplied by conveyors, indexers, or other container transport equipment (which will be collectively referred to as "conveyors" throughout the remainder of this document). Automatic filling systems are necessarily more complex because the extent of filling of the containers must be measured, either gravimetrically, volumetrically, or by other methods, and the filling units which effect filling must communicate with the conveyors to synchronize the filling operation with the container supply. Examples of prior automatic filling systems follow.

U.S. Pat. No. 4,398,577 to Sauer illustrates a mobile volumetric filling unit with twin filling heads. The mobile filling unit may be wheeled to various filling stations (such as conveyor lines) and positioned so that the filling heads are situated over filling positions to which empty containers are indexed. Fluid is volumetrically dispensed from each filling head, and dispensation is synchronized with the filling station/conveyor by a chain and sprocket arrangement. The filling unit may be disconnected from the filling station by removal of the chain, allowing the filling unit to be removed from the filling station and wheeled to cleaning areas, or to other filling stations for reconnection.

U.S. Pat. No. 5,505,233 to Roberts et al. describes a mobile gravimetric filling unit with multiple filling heads which may be wheeled between a filling station (such as a conveyor) at which weight sensors are located, and cleaning or other areas. Empty containers are indexed on the conveyor to rest over weight sensors. Fluid is then dispensed from the filling heads into the containers, and once each container reaches a desired weight, dispensation ceases. The filling unit communicates with the weight sensors by use of pneumatic lines. In commercial versions of this and similar filling systems, disconnectable pneumatic lines are used between the filling unit(s) and the filling station so that one filling unit can be disconnected from the pneumatic lines and replaced with another filling unit. Alternatively, a pair of filling units may be simultaneously pneumatically connected to the filling station, with only one filling unit being positioned adjacent to (and being used at) the filling station at a time. When it is desired to have the other filling unit perform filling, the first filling unit is wheeled away from the filling station and the other is wheeled in to replace it. The filling units can both remain connected to the filling station throughout this process, though disconnects are provided on their pneumatic lines so that either filling unit can be disconnected from the filling station if desired.

To better illustrate filling systems of this nature, it is useful to review a filling system owned by the Fuller O'Brien Company (South San Francisco, Calif., USA) for use in paint filling operations, and which was displayed at the Oct. 21–23, 1992 Paint and Coatings Federation Trade Show in Chicago, Ill. This filling system included two mobile filling units, each having a vertical mast bearing a wheel at its bottom, with the mast supporting a bank of four filling heads. The mast of each mobile filling unit had an arm which extended horizontally to pivotally connect to a conveyor. Thus, each filling unit could be wheeled in an arc along the floor up to a filling position at the conveyor, at which point its arm rested parallel and adjacent to the conveyor, and each of its filling heads rested over a corresponding gravimetric weight sensor on the conveyor. From this position, each filling unit could also be wheeled away from the conveyor, e.g., to a cleaning area where its filling heads were situated away from the filling position. The pivot points for the two arms of the filling units were spaced apart on the same side of the conveyor such that the mobile filling units could interchangeably swing to the same filling position over the weight sensors. Electrical communication lines ran from the weight sensors to a control box associated with the conveyor, and pneumatic lines then extended from the control box to the filling heads of the filling units. Thus, the filling heads communicated with the weight sensors via an electrical-to-pneumatic interface, and dispensed fluid into containers on the weight sensors in accordance with the weight sensed thereon. The pneumatic lines were removably connected to the filling heads by quick-disconnect fittings. An electrical line also ran from the control box to terminate at a limit switch on each arm so that when a filling unit was moved to the filling position, the switch on its arm contacted the conveyor, thereby allowing the controls to detect when the filling unit was at the filling position or the cleaning area. A filling unit at the filling position could be latched to the conveyor to prevent its filling heads from swinging out of alignment with the weight sensors at the filling position.

In operation, a first one of the filling units was latched to the conveyor at the filling position, and it was connected to a fluid product source (e.g., a tank). Each of its filling heads were situated over a corresponding weight sensor on the conveyor to allow gravimetric filling of containers situated thereon. The second filling unit was situated away from the filling position at a cleaning area, and was connected to a source of flushing fluid so that its filling head could be flushed out, with the flushing fluid being received by a vat. Once cleaning of the first filling unit was desired, it was disconnected from the product source, unlatched from the conveyor, and wheeled along an arc defined by its arm to a location distant from the filling position. The source of flushing fluid was then disconnected from the second filling unit and connected to the first filling unit for flushing. The second filling unit was wheeled on the floor along an arc defined by its arm into the filling position, at which point its filling heads were situated over the load cells on the conveyor. It was then connected to the fluid product source so it could perform gravimetric filling of containers on the load cells.

One disadvantage of the foregoing filling systems is their requirement that a communications connection be established between the filling unit and the filling station in order to allow filling to be synchronized with the container supply: Sauer requires the chain of the filling unit be connected to the filling station, and the filling systems of the Roberts et al. type require that the pneumatic lines of the filling units be connected to the filling station and its weight sensors. These connections may take time to establish and verify; consider, for example, that the chain of Sauer must be attached to the sprocket at a correct location, or else the synchronization between the filling unit and conveyor will be improperly timed. Similarly, since several pneumatic lines are required between a Roberts et al. -type filling unit and filling station for proper communication between the filling unit and weight sensors, one must verify that the pneumatic lines are properly connected to avoid ill-timed fluid dispensation. Additionally, the mechanical and pneumatic connections of Sauer and Roberts et al., which essentially have the nature of "umbilicals" which extend between the filling unit and filling station, can provide a tripping hazard, are subject to damage during transport of the filling units or when activities occur in the filling environment, and/or can be fouled (e.g., by product spills). Damage and/or fouling can make connection between the filling units and filling stations difficult (or impossible), or it may interfere with proper synchronization. Further, the mechanical and pneumatic connections can remain connected when the filling units are knocked to some degree out of alignment with their filling stations, thereby allowing the filling units to continue dispensing fluid even when the fluid is only partially being received within the containers (and the remainder is being dispensed onto the filling station).

The inventor and his colleagues have considered various options for filling systems that might eliminate the need for a communications connection between the filling unit and filling station, whereby a filling unit may be quickly placed adjacent a filling station with its filling head(s) over the container filling positions without the need to establish a physical communications connection between the filling unit and filling station. As an example, a filling unit and filling station might communicate via a wireless interface (e.g., by radio frequency communications) so that filling/synchronization messages may be communicated therebetween. However, such electronic communications are subject to noise interference from other electronics in the filling system's environment, and additionally the components needed to enable such communications are prohibitively expensive (at the time this document was filed as a patent application). The same is true of sonic/ultrasonic communications, which are even more subject to noise interference.

Another option is to have the filling unit communicate with the filling station by optical communications, as by transmission of an infrared filling/synchronization signal. Optical communications have the advantage that they are highly directional, and thus the filling unit must be properly situated with respect to the filling station during dispensation in order to enable the communications (and thus in order to enable dispensation of fluid). In other words, an operator need not worry about the filling unit dispensing fluid when the filling unit is misaligned with respect to the filling station in such a manner that it dispenses fluid out of, or only partially within, the containers to be filled. However, while optical communications components have reasonable cost, they are particularly subject to fouling by spilled product: once spilled product distorts or obscures the light beam which provides the filling signal, the system becomes inoperative or malfunctions.

An additional problem with all of the foregoing modes of communication is that they generally require electronics for operation, and it is often desirable to avoid electronics in filling environments wherein flammable materials are used. To illustrate, many filling units are flushed or cleaned using volatile solvents, and electronics can cause ignition of the solvents or their vapors. This is why pneumatic actuation of (and communication between) filling units and filling stations is commonly used. There are known and commonly used methodologies and equipment for explosion-proofing electronics in filling systems, but it would be useful to avoid the cost and inconvenience of these measures.

Thus, to summarize, it would be useful to have a filling system wherein the filling unit (or units) is repositionable with respect to the filling station, and wherein filling/synchronization signals are communicated between the filling unit(s) and filling station without the need for a communications connection therebetween.

SUMMARY OF THE INVENTION

The invention, which is defined by the claims set forth at the end of this document, is directed to methods and apparata which at least partially alleviate the aforementioned problems. A basic understanding of some of the preferred features of the invention can be attained from a review of the following brief summary of the invention, with more details being provided elsewhere in this document.

A preferred version of the invention involves a fluid product filling system having a filling unit which is repositionable with respect to a filling station. The filling unit includes a filling head and a dispensing switch. The filling head may be switched between two states, a filling state wherein fluid product is dispensed from the filling head, and a nonflow state wherein fluid product dispensation is ceased. The dispensing switch, which may be a contact or proximity switch, may be actuated to change the filling head between these states.

The filling station has a filling position at which a container may be placed for filling with fluid product. A container fill sensor, e.g., a weight sensor such as a load cell or digital scale, is preferably provided on the filling station at the filling position so that it may detect the degree to which a container situated at the filling position is filled with fluid product. A movable switching member is also preferably provided on the filling station, and it communicates with the container fill sensor and moves to different positions in accordance with the degree to which a container at the filling position is filled. For example, the switching member may be provided by a rod driven by a pneumatic cylinder.

The filling unit is repositionable with respect to the filling station so that the filling unit may be situated adjacent the filling station with its filling head situated over the filling position, or may be moved to allow the filling unit to rest at other locations. When the filling unit is resting adjacent the filling station with its filling head situated over the filling position (i.e., when it is in the ready-to-fill position), the switching member and dispensing switch are adjacently situated between the filling unit and filling station so that the switching member may actuate the dispensing switch. No connection between the switching member and dispensing switch is made, and instead the switching member simply extends to push or otherwise act on the dispensing switch to actuate the filling head. To illustrate, where the switching member is a rod driven by a cylinder (or is some other form of linear or pivoting actuator), the switching member may act as a finger which actuates the dispensing switch. Where the dispensing switch is a proximity switch rather than a contact switch (for example, a magnetic proximity switch), the switching member need only approach the dispensing switch to a sufficient degree that the dispensing switch is actuated, and no contact between the switching member and dispensing switch is necessary.

Thus, when the container fill sensor then detects that filling is to occur (or is to cease), the switching member is actuated, which in turn actuates the dispensing switch to change the filling head between its filling state and its nonflow state in accordance with the filling detected by the container fill sensor. When the filling unit is moved away from the filling station such that its filling head is no longer situated over the filling position, the switching member cannot reach or actuate the dispensing switch and the filling unit becomes inoperable (with the filling head preferably being normally close, but opened by the dispensing switch, so that it will automatically be closed once the filling unit is moved away from the filling station).

The foregoing arrangement has exceptionally fast shutdown and start-up time because a filling unit only needs to be put in the ready-to-fill position, with its filling head situated over the filling position, in order to establish communications between the filling unit and the filling station. No connections between the filling unit and filling station are required. This lack of connections also reduces maintenance and increases safety, since there need not be any pneumatic or electric lines extending between the filling unit and filling station. Such lines can cause tripping or which can easily be damaged by traffic adjacent to the filling operations, either while they are connected or when they are disconnected and trailing from the filling unit and/or filling station. It is also notable that when the invention is used in lieu of filling systems wherein pneumatic communications conduits are connected between the filling unit and filling system, the invention provides more accurate filling. This is because pneumatic communications signals are subject to degradation and delay, as they may only travel at the speed of sound, and a portion of the signal is lost owing to expansion of flexible pneumatic conduits (particularly in longer conduits). Where pneumatics are used in the invention, such degradation and delay is greatly reduced because the length of any pneumatic circuits allowing communication between the filling unit and filling station are interrupted by the switching member and dispensing switch. For example, as compared to prior filling systems wherein a pneumatic communication line extended from the filling unit to a container fill sensor at the filling station, the invention allows the lengths of the pneumatic lines on the filling unit side and the filling station side to be reduced by as much as one-half.

Further advantages, features, and objects of the invention will be apparent from the following detailed description of the invention in conjunction with the associated drawings.

DETAILED DESCRIPTION OF PREFERRED VERSIONS OF THE INVENTION

Figure 1:
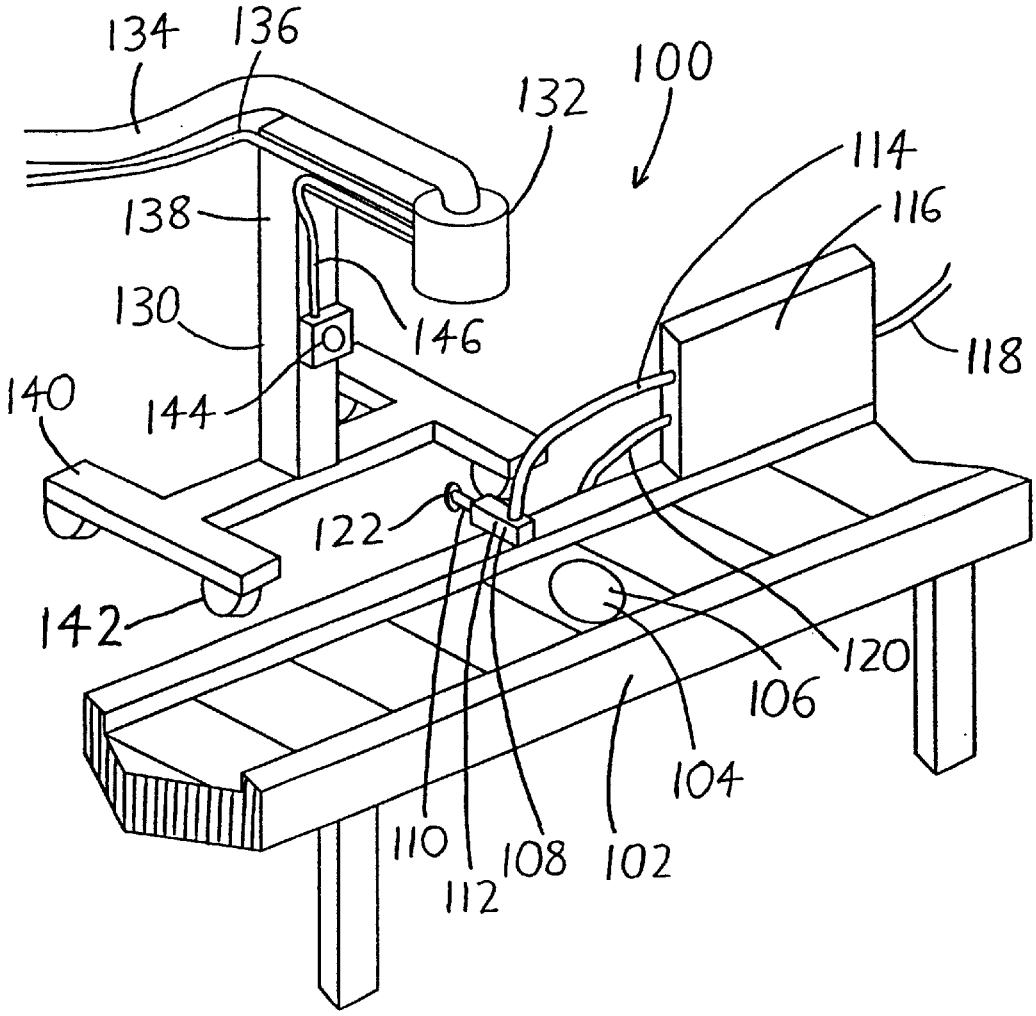
FIG. 1 is a simplified perspective view of an exemplary version of the invention.

An exemplary preferred version of the invention is illustrated in FIG. 1, wherein a filling system 100 is shown with a filling station 102 (the filling station 102 in this case being provided by a conveyor) and a filling unit 130. The filling station 102 has a filling position 104 at which a container traveling on the conveyor is to be filled with fluid product. A container fill sensor 106 (e.g., a weight sensor such as a load cell or digital scale) is situated at the filling position 104 so that it may detect the degree to which a container situated at the filling position 104 is filled with fluid product. A movable switching member 108 is also provided on the filling station 102, preferably at a point adjacent to the filling position 104 and at or near one of the boundaries of the filling station 102 (in the filling system 100 of FIG. 1, at the edge of the conveyor of the filling station 102). The switching member 108 is shown with a rod 110 which is driven by a pneumatic cylinder 112. One or more pneumatic switching member driver lines 114, which provide a signal to actuate the rod 110, are shown extending from the cylinder 112 of the switching member 108 to a control box 116. The control box 116 is shown with a air source line 118 which leads to a pressurized gas source so as to provide the motive force for any pneumatic components associated with the filling station 102 and control box 116 (e.g., to provide the gas for pneumatically driving the switching member 108).

One or more sensor communication lines 120, which are generally electrical but which may be pneumatic if a container fill sensor 106 having pneumatic inputs/outputs is used, are also shown leading to the control box 116. Within the control box 116, an appropriate control system, such as a programmable logic controller or other digital or analog control system, allows the container fill sensor 106 to communicate with the switching member 108 so that the switching member 108 (and more particularly its rod 110) will move to different positions in accordance with the degree to which the container at the filling position 104 is filled with fluid product.

The filling unit 130 has a filling head 132 from which fluid product is dispensed (in FIG. 1, from the underside of the filling head 132). The filling unit 130 is supplied with fluid product from a fluid product conduit 134, which is itself supplied from a fluid product supply such as a tank (not shown). It should be understood that the filling head 132 has one or more valves therein (these valves not being shown), or that it by itself constitutes a valve, whereby the filling head 132 may change between a filling state wherein fluid product is dispensed from the filling head 132, and a nonflow state wherein fluid product dispensation is ceased. Where the filling head 132 and its valves or other components are pneumatically driven, one or more pneumatic filling head driver lines 136 may extend from the filling head 132 and filling unit 130 to a pressurized gas source. Alternatively, if the components of the filling head 132 are electrically or otherwise driven, the filling head driver line 136 may take the form of an electrical or other line.

The filling head 132 is supported by a mast 138 which descends to a wheeled base 140, with the wheels being depicted at 142 in FIG. 1. The wheels render the filling unit 130 mobile and allow it to be repositioned with respect to the filling station 102. The filling unit 130 may be put in a ready-to-fill position wherein it is situated adjacent the filling station 102 with its filling head 132 situated over the filling position 104, or it may be moved to allow the filling unit 130 to rest at other locations, such as at cleaning areas spaced away from the filling station 102, at other filling positions 104 situated on the same filling station 102 (or at other filling stations 102), etc.

A dispensing switch 144 is provided on the mast 138 (or another portion of the filling unit 130) so that when the filling unit 130 is resting adjacent the filling station 102 with its filling head 132 situated over the filling position 104, the dispensing switch 144 is situated adjacently to the switching member 108 so that the switching member 108 may actuate the dispensing switch 144. In the filling system 100 of FIG. 1, the dispensing switch 144 is depicted as a pneumatic contact switch which opens and closes one or more pneumatic head switching line(s) 146 leading to the filling head 132. The dispensing switch 144 communicates with the filling head 132 via the head switching line(s) 146 so that when the dispensing switch 144 is actuated, the filling head 132 is switched between its filling state and its nonflow state. As will be discussed elsewhere in this document, a particularly preferred arrangement is to have the filling head 132 normally be in its nonflow state, but when the dispensing switch 144 is actuated, the filling head 132 will switch to its filling state.

The filling system 100 may use a pneumatic contact switch for use as the dispensing switch 144, whereby the dispensing switch 144 provides a signal to the filling head 132 only when it is physically pressed or released. However, rather than using contact switches, the filling system 100 may instead use proximity (i.e., noncontact) switches. Exemplary pneumatic switches suitable for use in the invention are the Clippard pneumatic contact switch model 2011-1 and the Clippard model 1022 pneumatic proximity switch (Clippard Instrument Laboratory, Inc., Cincinnati, Ohio, USA). One particularly advantageous switch that may be used for the dispensing switch 144 is a magnetic proximity switch, and more particularly a pneumatic-magnetic proximity switch, which is triggered only when it is exposed to a magnetic field of sufficient intensity. An example of a switch of this nature is the Hecon model G0 490 300 pneumatic proximity switch (Hecon Corporation, Eatontown, N.J., USA), which provides a pneumatic output signal which changes when a magnet is sufficiently nearby (and the magnet need not contact the switch). Where the dispensing switch 144 takes the form of such a switch, the rod 110 of the switching member 108 may be tipped with a magnet 122. Thus, when filling is to start, the rod 110 may extend to have the magnet 122 approach (or contact) the dispensing switch 144, and the dispensing switch 144 will then place the filling head 132 in the filling state when the magnet 122 approaches the dispensing switch 144 by a sufficiently small distance. When the rod 110 is withdrawn from the dispensing switch 144 by a sufficient distance, the dispensing switch 144 places the filling head 132 in the nonflow state. This form of dispensing switch 144 is particularly useful because the dispensing switch 144 cannot be activated if accidentally bumped by an operator or by surrounding equipment, since exposure to the magnetic field is necessary.

In operation, when it is desired to have the filling system 100 fill containers, the filling unit is moved to rest adjacent the filling station 102 in the ready-to-fill position, with its filling head 132 situated over the filling position 104 and with its dispensing switch 144 situated adjacent the switching member 108. Containers are indexed along the conveyor of the filling station 102, and when the container fill sensor 106 detects the weight of an empty container thereon, the control box 116 ceases indexing of the conveyor of the filling station 102 to pause the container at the filling position 104 for filling. The control box 116 provides a signal to the switching member 108 to extend the rod 110 away from the cylinder 112 toward the filling unit 130, where it actuates the dispensing switch 144. The dispensing switch 144 communicates with the filling head 132 via the head switching line 146 to change it from the nonflow state to the filling state so that fluid product is dispensed from the filling head 132 into the container at the filling position 104. As dispensation of fluid product proceeds, the container fill sensor 106 (and thus the control box 116) detects the degree to which the container is filled with fluid product. When the container is at or near its desired degree of filling, the control box 116 sends a signal to the cylinder 112 of the switching member 108 to retract the rod 110, thereby having the dispensing switch 144 reset the filling head 132 to its closed state so that dispensation of fluid product from the filling head 132 ceases. The control box 116 then restarts the conveyor of the filling station 102 to carry away the filled container, and to index another empty container into the filling position 104 so that the foregoing filling process may be repeated.

The foregoing arrangement has numerous advantages in comparison to some of the prior filling systems noted earlier in this document. No pneumatic, electrical, or other communication lines/umbilicals need extend between the filling unit 130 and filling station 102, nor will they trail from the filling unit 130 and/or filling station 102 when the filling unit 130 is moved away from the filling station 102. Safety is enhanced because the danger of tripping over such umbilicals is eliminated. Maintenance, repair, and operational concerns are also reduced because such protruding umbilicals can be run over, pinched, or otherwise damaged or rendered inoperative, and the filling system 100 is not subject to these concerns.

Additionally, setup time is diminished because there is no need to attach one or more communications lines between the filling unit 130 and filling station 102; an operator only needs to situate the dispensing switch 144 adjacent the switching member 108. In prior filling systems where pneumatic communications were used between the filling unit 130 and filling station 102, at least one pneumatic or electrical communications line was required to be connected between the filling unit 130 and filling station 102 for each cooperating pair of filling heads and container fill sensors. Since some filling systems included as many as 2–6 filling heads and container fill sensors (as opposed to only the single pair depicted in the filling system 100 of FIG. 1), setup could be time-consuming because each line needed to be matched with and connected to its respective terminal. Since such connections are avoided in the present invention, setup time is substantially reduced.

It is notable that the lack of connection between the filling unit 130 and filling station 102 is particularly advantageous when a pneumatically-driven filling system 100 is used. Prior filling systems 100 having pneumatic communications between the filling station 102 and filling unit 130 had an inherent limit to the degree of filling accuracy that could be obtained. A pneumatic signal can only travel at the speed of sound, and is additionally subject to signal decay owing to pressure losses, air leaks, flexural hysteresis, etc. in the pneumatic line. Thus, a slight delay is always experienced between the time a pneumatic signal is sent from the filling station 102 to the filling unit 130 to start or stop filling, and this delay becomes more pronounced as the pneumatic lines between the filling unit 130 and filling station 102 increase in length. However, since the present invention can eliminate or greatly reduce the length of any pneumatic lines used for communication between the filling unit 130 and filling station 102, filling accuracy can be increased.

Further, the filling system 100 can be configured such that if the filling unit 130 is knocked even slightly out of alignment with the filling station 102 so that the filling head 132 does not fully rest over the filling position 104, the switching member 108 and dispenser switch 144 will not engage and no product dispensation will occur. Thus, the filling system 100 can eliminate or substantially reduce the danger of having severe product spills where the filling unit 130 is misplaced, and its filling head 132 only partially rests over the filling position 104.

In many filling operations, it is common to use a filling procedure known as "bulk-and-dribble filling" for greater filling accuracy, and also to prevent container overflows where foaming product is dispensed. In bulk-and-dribble filling, filling occurs by initially dispensing product at a high flow rate and then switching to a lower flow rate to "top off" the container. An exemplary arrangement for accomplishing bulk-and-dribble filling in the invention will now be described, though it should be understood that bulk-and-dribble filling may be obtained via other arrangements as well.

Figure 2A:
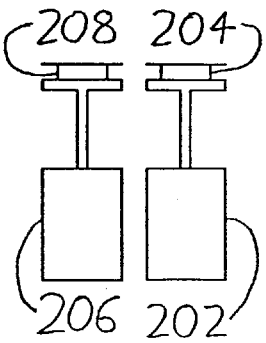
FIG. 2 is a schematic view of a dual switching member and dispensing switch arrangement that can be used to enable "bulk-and-dribble" filling.
Figure 2B:
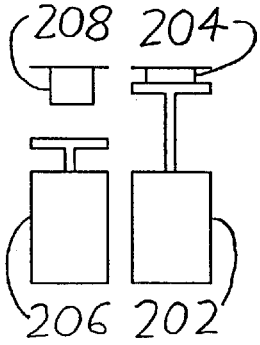
Figure 2C:
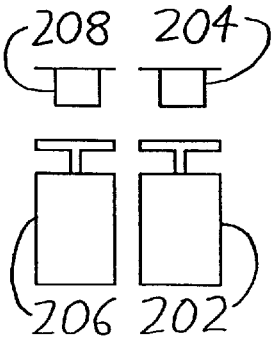

FIGS. 2A–2C illustrate an exemplary switching member and dispensing switch arrangement that may be used to effect bulk-and-dribble filling. Here, it is contemplated that a filling head in a filling unit would include two in-line valves, a bulk flow valve which may be fully closed, and a dribble flow valve which does not fully close (i.e., it has a smaller flow area which still allows passage of fluid product when fully closed). A pair of switching members and dispensing switches is provided for each of the valves, with FIGS. 2A–2C showing a bulk flow switching member 202, a corresponding bulk flowing dispensing switch 204, a dribble flow switching member 206, and a corresponding dribble flow dispensing switch 208. The first stage of the bulk-and-dribble filling process is illustrated in FIG. 2A. Here, after the container fill sensor detects the presence of an empty container, the control box actuates both the bulk flow switching member 202 and the dribble flow switching member 206 to place both the bulk flow dispensing switch 204 and the dribble flow dispensing switch 208 in their filling states. The bulk flow valve and dribble flow valve are both fully open, providing maximum flow area for bulk flow from the filling head into the container.

When the container fill sensor then detects that some predetermined weight of fluid product has entered the container, and it is time to switch from bulk flow to dribble flow, the control box sends a signal to the dribble flow switching member 206 to release the dribble flow dispensing switch 208, thereby placing the dribble flow valve in its partially closed state. The bulk flow switching member 202 continues to actuate the bulk flow dispensing switch 204. Since the flow rate of the filling head will necessarily be limited by the flow rate of the dribble flow valve (even though the bulk flow valve remains fully open), the flow area for fluid product decreases and the filling head will dispense at a decreased flow rate.

Finally, when the container fill sensor detects that the container is at or near the desired degree of filling, the control box sends a signal to cause the bulk flow switching member 202 to release the bulk flow dispensing switch 204. The bulk flow valve then fully closes and terminates all flow of liquid product.

It is understood that various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

Initially, while the foregoing examples and the prior patents cited in this document generally describe liquid product filling systems, the invention may be used for any flowing material, including flowing solids such as powders and particulates. Systems for flowing solids operate on generally the same principles as filling systems for liquids, though solid filling systems generally benefit from the addition of vibrators and/or other components which help to prevent the solids from clogging or flowing in clumps. See, e.g., U.S. Pat. No. 4,843,579 to Andrews et al.

While the use of gravimetric (weight-metering) container fill sensors are discussed, other forms of filling may be implemented. As an example, a container fill sensor may be configured such that it detects the level of fluid dispensed within a container as opposed to its weight; see, e.g., U.S. Pat. No. 4,445,548 to Neumann and/or U.S. Pat. No. 4,957,147 to Lowe as exemplary patents utilizing filling by level sensing. As another example, time-metered filling may be implemented by actuating the switching member via a timer (which may be provided, for example, in any controls system/control box associated with the filling station). In this case, a container fill sensor is not necessary. Hybrid forms of filling (that is, filling methods using more than one of gravimetric filling, volumetric filling, time-metered filling, etc.,) are also possible, with examples of such methodologies being provided in U.S. Pat. No. 6,148,877 to Bethke.

The number, placement, and arrangement of the various control/communication lines 114, 120, 136, and 146 may take a number of forms different from those previously described in the foregoing text and depicted in the drawings, and it should be understood that some of these lines may be eliminated or that additional lines can be added. The exemplary versions of the invention previously described in this document are described as using pneumatic communications because pneumatics are in common use in the filling industry and are relatively safe and inexpensive. However, any arrangement of lines, whether they communicate pneumatic, electrical, optical, or other signals, may be used in the invention so long as they allow the dispensing switch to communicate with the filling head, and so long as they allow the container fill sensor (if present) to communicate with the switching member. Additionally, such lines may be omitted from the invention if communication between these components can be achieved without the use of lines.

Where some or all of the various lines 114, 120, 136, and 146 are present, they may be subject to wear, puncture, and breakage when they are exposed to caustic cleaning materials, are struck by or pinched between other objects in their environment, etc. Additionally, where these lines are pneumatic, it is notable that plastic pneumatic lines may, after long periods of use, begin to leak owing to their long exposure to cycles of pressurization and depressurization. Repeated pressurization and depressurization may also cause them to become too compliant (i.e., they will partially expand when pressurized and partially collapse when depressurized), which can cause degradation of pneumatic signals. To diminish these problems in the filling system 100, the various lines 114, 120, 136, and 146 are all preferably made easily removable and replaceable by including quick-disconnect terminals at their ends. This is a useful measure regardless of whether some or all of these lines are pneumatic, electrical, or other types of lines. In similar fashion, the fluid product conduit 134 is preferably also provided with quick-disconnect terminals at one or more of its ends so that it may be easily removed and replaced when desired.

In versions of the invention other than the exemplary ones previously described, it is possible that filling might occur when dispensing switches are released or deactivated as opposed to being depressed or activated, and that filling heads may be in a normally open state as opposed to a normally closed state. Also, while the foregoing examples described filling signals as being binary value (on/off) switching signals communicated between the filling station/switching member and the filling unit/dispensing switch, filling can also occur on the basis of continuously-ranging switching signals being provided between the filling station and filling unit. For example, the rod 110 of the switching member 108 might achieve a degree of extension which varies in accordance with the weight sensed by the container fill sensor 106, and the dispensing switch 144 might vary the degree of flow through the filling head 132 in accordance with the degree to which it is depressed or released (and/or in accordance with the proximity of the rod 110 or magnet 122).

The invention may readily be extended beyond the use of a single filling head to the use of multiple filling heads. Where multiple filling heads are used, multipie container fill sensors may also be provided at multiple container filling positions so that each filling head dispenses fluid into a respective container in accordance with the degree of filling detected in that container. In this instance, multiple switching members and dispensing switches may be used. Alternatively, it is also possible to have multiple filling heads which each fill a respective container situated at one of multiple filling positions, but wherein a container fill sensor is provided for only one of the containers. In this instance, all filling heads dispense fluid into their respective containers in accordance with the degree of filling detected in the one container which is associated with the container fill sensor. Filling therefore proceeds under the assumption that the degree of filling for this container is representative of all containers. An example of a filling system operating on this principle is illustrated in U.S. Pat. No. 4,411,295 to Nutter. Only a single switching member and dispensing switch need be used in this case. It is also possible to have filling systems with multiple filling heads which operate between these two options (i.e., between the option of multiple filling heads each controlled by the filling degrees of their respective containers, and the option of multiple filling heads each controlled by the filling degree of one of the containers), and some subset of the containers being filled might control the dispensing of the multiple filling heads (e.g., by having the multiple heads all fill in accordance with the degree of filling averaged over some subset of the containers).

While most of the previously discussed filling stations involve conveyors for use as container transport systems, other forms of container transport systems may be used as well, such as star wheel indexers and pushers. It is also possible that the filling station may not include a container transport system, in which case the filling station may simply be a table or some other location which has a filling position at which a container is to be filled.

The invention may utilize filling units of the type having a separate fluid product supply (as exemplified by the filling unit shown in FIG. 1), or of the type where a fluid product supply is provided on the filling unit. Filling units of the type shown in FIG. 1 are advantageous insofar as they may be used with a separate source of pressurized fluid, and the cost of each filling unit may be reduced because the need for onboard pumps and the like is eliminated. Cleaning of the filling unit by flushing is also made somewhat simpler because no accompanying tank and pump need be flushed; rather, only the fluid inlet conduit and filling head (and any accompanying manifold or other portions of the fluid path) need be flushed.

A wide variety of different types of switches may be used for the dispensing switch apart from the pneumatic and magnetic contact and proximity switches previously noted. Virtually any form of switch, whether it operates in contact or proximity mode, is usable. A wide variety of sensors may be used as switches as well, so long as they have appropriate input/output characteristics. Switches which use electrical input/output are exceedingly common in industrial applications, such as electrical contact switches and proximity switches such as inductive proximity switches, capacitive proximity switches, Reed magnetic proximity switches, photoelectric proximity switches, and ultrasonic proximity switches. Most of these proximity switches can be used in contact mode as well as proximity mode. However, it should be understood that mechanical, pneumatic, or hydraulic analogs of these electrical switches are more desirable in wet environments, and/or in environments where flammable materials are being processed. One particularly advantageous switch is a pneumatic gap sensor, wherein a pneumatic signal is generated if an object sufficiently penetrates a gap. Where a gap sensor is used as the dispensing switch, the gap may be configured so that the switching member must enter the gap by a desired distance, and from a desired orientation, if the dispensing switch is to be triggered; for example, a gap formed as an elongated cylindrical bore might require axial insertion of a rodlike switching member by some desired distance before the dispensing switch is triggered. The dispensing switch and switching member may therefore require a very precise alignment between the filling unit and the filling station, i.e., with the filling head(s) very precisely oriented over the filling position(s), in order for filling to be actuated. Such an arrangement can better help to avoid improperly placing the filling unit with respect to the filling station in such a manner that spills occur during dispensation.

Similarly, a wide variety of switching members may be used apart from pneumatic actuators, such as other forms of linear actuators or rotary actuators (e.g., pivoting arms/links). Additionally, such actuators need not operate on pneumatic principles, but might instead operate via hydraulic, mechanical, electrical, or magnetic principles, or any combination of the foregoing principles.

The filling unit need not have wheels to be rendered repositionable with respect to the filling station, and it may instead merely be supported on legs, or may slide on tracks, or swing into place on an arm, or otherwise move between the ready-to-fill position and other positions. Where the filling unit is easily movable, it is useful to provide it with some form of brake so that it can be restrained in place when desired. As an example, locking casters can be used to wheel the filling unit from place to place, or screw jacks may be provided along with the wheels so that the screw jacks may be dropped to engage the floor when desired. The filling unit might alternatively or additionally include a latch or other locking mechanism whereby the filling unit may be affixed to selected portions of the filling station or its environment.

In filling systems such as the filling system 100 depicted in FIG. 1, additional safety measures can be added to prevent accidental dispensation of liquid product owing to unintended actuation of the dispensing switch 144 (for example, to prevent accidental dispensation where the dispensing switch 144 is a contact switch which is accidentally bumped). As an example, a limit switch might be added somewhere on the filling unit 130 (for example, somewhere on its base 140) with the limit switch contacting the filling station 102 or some adjacent structure when the filling unit 130 is situated at the filling station 102. For example, a limit switch on the filling unit 130 might contact a plate/stop which is affixed to the floor adjacent to the filling station 102. The limit switch could be appropriately connected to the head switching line 146 and/or the filling head 132 such that the filling head 132 cannot be placed in the filling state unless the limit switch is triggered. So long as the limit switch is situated distantly from the dispensing switch 144, it is unlikely that both the limit switch and dispensing switch 144 will be accidentally activated at the same time.

The invention is not intended to be limited to the preferred versions described above, but rather is intended to be limited only by the claims set out below. Thus, the invention encompasses all alternate versions that fall literally or equivalently within the scope of these claims.

What is claimed is:

1. A filling system comprising:

a. a filling station including:

(i) a filling position at which a container may be filled;

(ii) a switching member which moves in accordance with the degree to which a container at the filling position is filled;

b. a filling unit including:

(i) a filling head, the filling unit having a filling state wherein product is dispensed from the filling head and a nonflow state wherein product dispensation is ceased;

(ii) a dispensing switch which is actuated to change the filling unit between the filling state and the nonflow state;

wherein:

the filling unit is repositionable with respect to the filling station to allow the filling unit to rest adjacent the filling station with its filling head situated over the filling position, or to allow the filling unit to rest at other locations;

the switching member is situated adjacent the dispensing switch to actuate the dispensing switch only when the filling unit is resting adjacent the filling station with the filling head situated over the filling position.

2. The filling system of claim 1 wherein the dispensing switch is not connected to the switching member.

3. The filling system of claim 1 wherein the switching member extends and retracts from the filling station when the filling unit is resting adjacent the filling station with the filling head situated over the filling position.

4. The filling system of claim 3 wherein the switching member comprises one or more linear actuators.

5. The filling system of claim 3 wherein the switching member is not connected to the dispensing switch.

6. The filling system of claim 5 wherein the switching member does not contact the dispensing switch.

7. The filling system of claim 1 wherein the dispensing switch is magnetically actuated.

8. The filling system of claim 1 wherein the filling head is normally in the nonflow state, and is changed to the filling state when the dispensing switch is actuated.

9. A filling system comprising:

a. a filling station including:

(i) a filling position at which a container may be placed, (ii) a container fill sensor which detects the filling of a container at the filling position, and (iii) a switching member which moves in accordance with the detected filling of a container;

b. a filling unit including:

(i) a filling head, the filling head having a filling state wherein product is dispensed from the filling head and a nonflow state wherein product dispensation is ceased;

(ii) a dispensing switch which changes the filling head between the filling state and the nonflow state;

wherein the filling unit is repositionable to:

(1) situate its filling head over the filling position, at which time the switching member is situated adjacent the dispensing switch to actuate the dispensing switch, or (2) situate its filling head at locations away from the filling position, at which time the switching member does not actuate the dispensing switch.

10. The filling system of claim 9 wherein the dispensing switch is not connected to the switching member.

11. The filling system of claim 9 wherein the switching member does not contact the dispensing switch.

12. The filling system of claim 9 wherein the switching member extends and retracts from the filling station and between the filling unit and filling station when the filling unit is positioned with its filling head situated over the filling position.

13. The filling system of claim 9 wherein the container fill sensor pneumatically communicates with the switching member.

14. The filling system of claim 9 wherein the switching member magnetically communicates with the dispensing switch.

15. A filling system comprising:

a. a filling station including:

(i) a filling position at which a container may be placed, and (ii) a container fill sensor which detects the filling of a container at the filling position;

b. a filling unit including:

(i) a filling head, and (ii) a dispensing switch, the dispensing switch having a filling state wherein product is dispensed from the filling head and a nonflow state wherein product dispensation from the filling head is ceased;

wherein the filling unit is repositionable with respect to the filling station to situate its filling head:

(1) at locations away from the filling position; or (2) over the filling position with the dispensing switch situated between the filling unit and the filling station, with the dispensing switch being actuated between the filling state and nonflow state in accordance with the filling detected by the container fill sensor, and wherein the dispensing switch is not connected to the filling station.

16. The filling system of claim 15 wherein the filling station does not contact the dispensing switch.

17. The filling system of claim 15 wherein the container fill sensor communicates with a switching member on the filling station, and wherein the switching member actuates the dispensing switch when the filling head of the filling unit is situated over the filling position.

18. The filling system of claim 17 wherein the container fill sensor pneumatically communicates with the switching member.

19. The filling system of claim 17 wherein the switching member does not contact the dispensing switch.

20. The filling system of claim 17 wherein the switching member magnetically actuates the dispensing switch.

21. A filling system comprising:

a. a filling station including:

(i) a filling position at which a container may be placed, (ii) a container fill sensor situated at the filling position, wherein the container fill sensor detects the degree to which the container is filled with product, and (iii) a switching member actuated by the container fill sensor, wherein the switching member moves to different positions in accordance with the degree to which the container is filled with product;

b. a filling unit including:

(i) a filling head, the filling head being changeable between a filling state wherein product is dispensed from the filling head and a nonflow state wherein product dispensation is ceased;

(ii) a dispensing switch which may be actuated to change the filling head between the filling state and the nonflow state;

wherein:

(1) the filling unit is repositionable, whereby it may be situated at a filling location adjacent the filling station with its filling head situated over the filling position or at other locations;

(2) when the filling unit is situated at the filling location, the switching member is situated adjacent the dispensing switch to actuate the dispensing switch.

22. The filling system of claim 21 wherein the dispensing switch is not connected to the filling station.

* * * * *